US011025020B2

(12) United States Patent
Lu et al.

(10) Patent No.: US 11,025,020 B2
(45) Date of Patent: Jun. 1, 2021

(54) PERIPHERAL DEVICE

(71) Applicants: DEXIN ELECTRONIC LTD., Guangdong (CN); DEXIN CORPORATION, New Taipei (TW)

(72) Inventors: Ho-Lung Lu, New Taipei (TW); Hung-Jen Chou, New Taipei (TW)

(73) Assignees: DEXIN ELECTRONIC LTD., Guangdong (CN); DEXIN CORPORATION, New Taipei (TW)

( * ) Notice: Subject to any disclaimer, the term of this patent is extended or adjusted under 35 U.S.C. 154(b) by 0 days.

(21) Appl. No.: 16/591,594

(22) Filed: Oct. 2, 2019

(65) Prior Publication Data

US 2020/0212640 A1 Jul. 2, 2020

(30) Foreign Application Priority Data

Dec. 26, 2018 (TW) ..... 107147189

(51) Int. Cl.

| | |
|---|---|
| ***H01R 31/00*** | (2006.01) |
| ***H01R 13/66*** | (2006.01) |
| ***H01R 13/70*** | (2006.01) |
| ***H01R 24/64*** | (2011.01) |
| ***H01R 24/60*** | (2011.01) |
| *H01R 107/00* | (2006.01) |

(52) U.S. Cl.

CPC ..... *H01R 31/005* (2013.01); *H01R 13/6675* (2013.01); *H01R 13/70* (2013.01); *H01R 24/64* (2013.01); *H01R 2107/00* (2013.01); *H01R 2201/06* (2013.01)

(58) Field of Classification Search

CPC .. H01R 31/005; H01R 13/6675; H01R 13/70; H01R 24/64; H01R 2107/00; H01R 2201/06; H01R 24/60; H01R 13/6683

USPC ..... 710/14–16, 62, 105, 110

See application file for complete search history.

(56) References Cited

U.S. PATENT DOCUMENTS

| | | | | |
|---|---|---|---|---|
| 10,210,122 | B2 * | 2/2019 | Feng | G06F 1/266 |
| 2011/0029703 | A1 * | 2/2011 | Huo | G06F 13/4068 710/110 |
| 2013/0344705 | A1 * | 12/2013 | Mikhnenko | H01R 35/04 439/13 |
| 2014/0365695 | A1 * | 12/2014 | Peng | G06F 13/385 710/110 |
| 2015/0220139 | A1 * | 8/2015 | Puthillathe | G06F 13/385 713/323 |
| 2016/0004287 | A1 * | 1/2016 | Qiu | H01R 24/62 713/300 |

(Continued)

*Primary Examiner* — Idriss N Alrobaye
*Assistant Examiner* — Henry W Yu
(74) *Attorney, Agent, or Firm* — Li & Cai Intellectual Property Office

(57) ABSTRACT

A peripheral device having a connector receptacle capable of identifying a master-slave mode includes a body and a connector module. The connector module includes a processing unit, an energy storage unit, and a connector receptacle. When the connector module is connected to an electronic device through a power positive terminal, a power negative terminal, a signal positive terminal, a signal negative terminal, and a transmission cable, the processing unit transmits a notification signal to the electronic device through the positive terminal of the signal and the negative terminal of the signal to notify the electronic device that the electronic device does not need to provide power to the peripheral device.

9 Claims, 3 Drawing Sheets

(56) References Cited

U.S. PATENT DOCUMENTS

| | | | | |
|---|---|---|---|---|
| 2016/0342492 | A1* | 11/2016 | Chen | G06F 13/4282 |
| 2016/0378704 | A1* | 12/2016 | Adamson | G06F 13/385<br>710/104 |
| 2017/0364114 | A1* | 12/2017 | Sporck | G05F 3/08 |

* cited by examiner

PERIPHERAL DEVICE

CROSS-REFERENCE TO RELATED PATENT APPLICATION

This application claims the benefit of priority to Taiwan Patent Application No. 107147189, filed on Dec. 26, 2018. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a peripheral device, and more particularly to a peripheral device having a connector receptacle capable of identifying a master-slave mode.

BACKGROUND OF THE DISCLOSURE

With the increasing number of electronic devices, the corresponding increase of transmission cables is inevitable. However, the most convenient way for users to obtain cables, e.g., USB cables, is through the manufacturer.

When the mobile phone or tablet computer needs to control peripheral devices in a master mode, a specific OTG (On the Go) cable is required, which contains five core wires corresponding to five output terminals of a connector port. Aside from a power positive terminal, a power negative terminal, a signal positive terminal, and a signal negative terminal, one signal terminal is further provided. In light of the foregoing, the purchase and storage of cables can greatly inconvenience users thereof.

Therefore, providing a peripheral device that reduces the purchase cost of cables for users is an important issue in the industry.

SUMMARY OF THE DISCLOSURE

In response to the above-referenced technical inadequacies, the present disclosure provides a peripheral device having a connector receptacle that is capable of identifying a master-slave relationship. The peripheral device having a connector receptacle that is capable of identifying a master-slave relationship includes a body and a connector module disposed on the peripheral device body. The connector module includes a processing unit, an energy storage unit electrically connected to the processing unit to provide power to the processing unit, and a connector receptacle electrically connected to the processing unit. The connector receptacle is a Type-A universal serial bus connection receptacle. The connector receptacle includes a power positive terminal, a power negative terminal, a signal positive terminal, and a signal negative terminal. When the connector module is connected to an electronic device through the power positive terminal, the power negative terminal, the signal positive terminal, the signal negative terminal, and a transmission cable, the processing unit transmits a notification signal to the electronic device through the positive terminal of the signal and the negative terminal of the signal to notify the electronic device that the electronic device does not need to provide power to the peripheral device.

In one aspect, the present disclosure provides a peripheral device having a connector module capable of identifying a master-slave mode. The peripheral device having a connector module capable of identifying a master-slave mode includes a body, and a connector module disposed on the peripheral device body. The connector module includes: a processing unit; an energy storage unit electrically connected to the processing unit to provide power to the processing unit; and a connector receptacle electrically connected to the processing unit. The connector receptacle is a Type-A universal serial bus receptacle. The connector receptacle includes a power positive terminal, and a power negative terminal, a signal positive terminal, and a signal negative terminal. When the connector module is connected to an electronic device through the power positive terminal, the power negative terminal, the signal positive terminal, the signal negative terminal of the connector receptacle, and a transmission cable, the processing unit transmits a notification signal to the electronic device through the signal positive terminal and the signal negative terminal to notify the electronic device to switch from a slave mode to a master mode.

Therefore, the peripheral device of the embodiment of the present disclosure can achieve the OTG (On the Go) function by using the connector module capable of identifying a master-slave mode and the common four-core transmission cable. The purchase cost can therefore be greatly reduced for a user.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
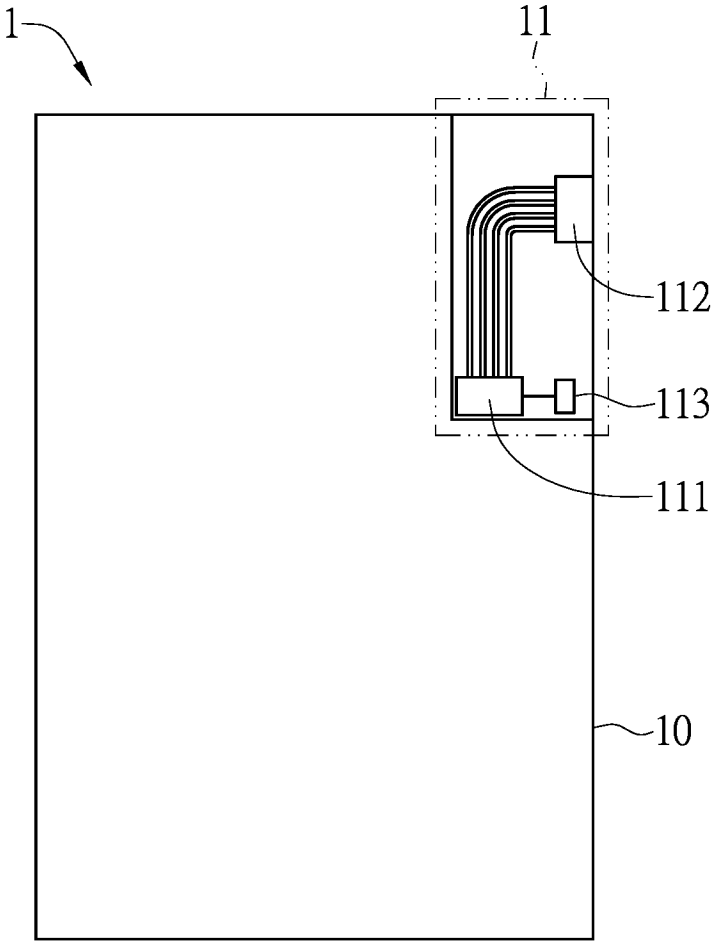
FIG. 1 is a schematic view of a peripheral device according to an embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way.

Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Figure 2:
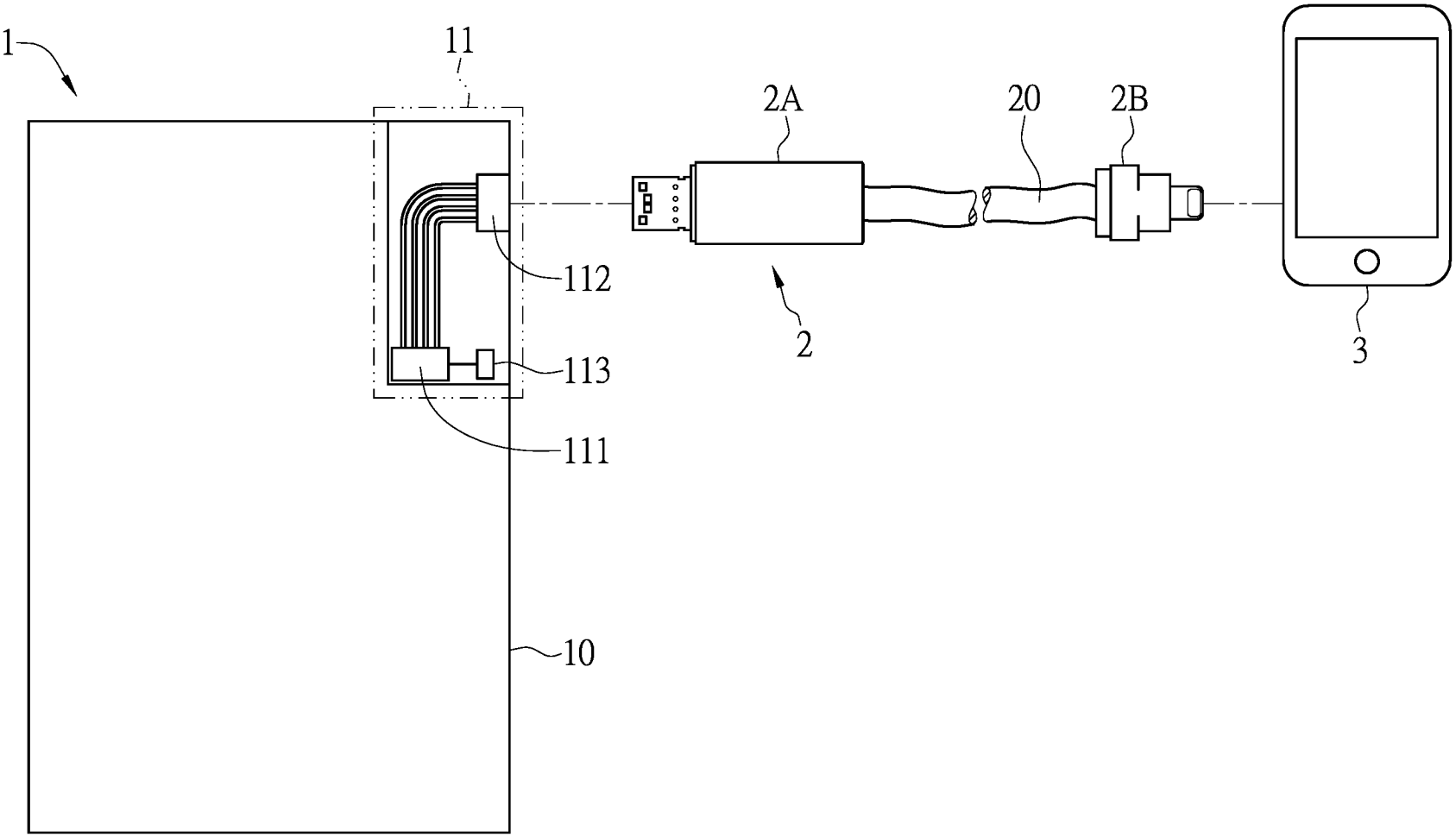
FIG. 2 is a schematic diagram of a peripheral device electrically connected to an electronic device through a transmission cable according to an embodiment of the present disclosure.

Referring to FIG. 1 to FIG. 2, FIG. 1 is a schematic view of a peripheral device according to an embodiment of the present disclosure. FIG. 2 is a schematic diagram of a peripheral device electrically connected to an electronic device through a transmission cable according to an embodiment of the disclosure.

In the embodiment, a peripheral device 1 includes a body 10 and a connector module 11. The connector module 11 is disposed on the body 10.

In the embodiment, the body 10 is a mouse pad. In other embodiments, the body 10 may be other peripheral devices, such as a mouse, a keyboard, a touch pad, or a tablet.

The connector module 11 includes a processing unit 111, a connector receptacle 112, and an energy storage unit 113.

The energy storage unit 113 is electrically connected to the processing unit 111 for supplying power to the processing unit 111. The connector receptacle 112 is electrically connected to the processing unit 111.

In the embodiment, the connector receptacle 112 is a Type-A universal serial bus receptacle (USB receptacle). The connector receptacle 112 includes a power positive terminal (not shown), a power negative terminal (not shown), a signal positive terminal (not shown), and a signal negative terminal (not shown).

When the connector module 11 is connected to an electronic device 3 through the power positive terminal (not shown) of the connector receptacle 112, the power negative terminal (not shown), the signal positive terminal (not shown), and the signal negative terminal (not shown), the processing unit 111 detects whether the electronic device 3 is in a master mode or a slave mode. In the embodiment, the signal negative terminal (not shown) is a ground terminal.

When the connector module 11 is connected to the electronic device 3 through the power positive terminal (not shown), the power negative terminal (not shown), the signal positive terminal (not shown), and the signal negative terminal (not shown) of the connector receptacle 112, and the electronic device 3 is in the slave mode, the processing unit 111 transmits a notification signal to the electronic device 3 through the signal positive terminal (not shown) and the signal negative terminal (not shown). Therefore, the electronic device 3 is notified to switch from the slave mode to the master mode. Furthermore, the electronic device 3 is also notified that it is not necessary to provide power to the peripheral device 1.

In other words, when the connector module 11 is connected to the electronic device 3 through the power positive terminal (not shown), the power negative terminal (not shown), the signal positive terminal (not shown), and the signal negative terminal (not shown) of the connector receptacle 112, and the transmission cable 2, the electronic device 3 is in a master mode.

In the embodiment, the processing unit 111 transmits a notification signal to the electronic device 3 through the signal positive terminal (not shown) and the signal negative terminal (not shown) of the connector receptacle 112 by a first custom protocol.

In the embodiment, the peripheral device 1 includes a keyboard, a mouse, a mouse pad, a touch pad, a tablet, and a wearable electronic device, but is not limited thereto in the present disclosure. The electronic device 3 includes a mobile phone, a tablet computer, a smart watch, and a wearable electronic device, but is not limited thereto in the present disclosure.

In the master mode, the user can read a data of the peripheral device 1 through the electronic device 3. A control signal can be transmitted to the electronic device 3 by the user through the peripheral device 1. For example, in the embodiment, when the peripheral device 1 is a mouse or a keyboard, and the electronic device 3 is electrically connected to the peripheral device 1, the peripheral device 1 can transmit a control signal to the electronic device 3 to move the cursor or input a message.

The transmission cable 2 includes a first connection module 2A, a cable body 20 and a second connection module 2B. The first connection module 2A is a male connector, In other words, the first connection module 2A is a male connector corresponding to the connector receptacle 112. In the embodiment, the first connection module 2A is a Type-A universal serial bus connector.

The second connection module 2B includes: a Type-A universal serial bus connector, a lightning connector, and a micro universal serial bus connector (Micro USB).

In the embodiment, the connector receptacle 112 is a Type-A universal serial bus bar receptacle. The transmission cable 2 is a four-core cable. At present, the transmission cable of a mobile phone or a tablet computer on the market generally includes a four-core cable or a five-core cable, which includes four wires or five wires. However, one of the wires of the five-core cable is used for electromagnetic shielding. In other words, the additional wire is wound around the outside of the four wires and electrically connected to the power negative terminal (not shown), namely, the additional wire is electrically connected to the ground. In other words, even if the five-core cable includes five wires, the output of the five-core cable only includes four terminals.

However, an OTG (On the Go) transmission cable includes five wires and five terminals, which is different from the common four-core transmission cable.

In the embodiment, the energy storage unit 113 includes a battery, a super capacitor, or a DC-DC transformer module, but can be adjusted according to actual requirements, and is not limited in the present disclosure.

Figure 3:
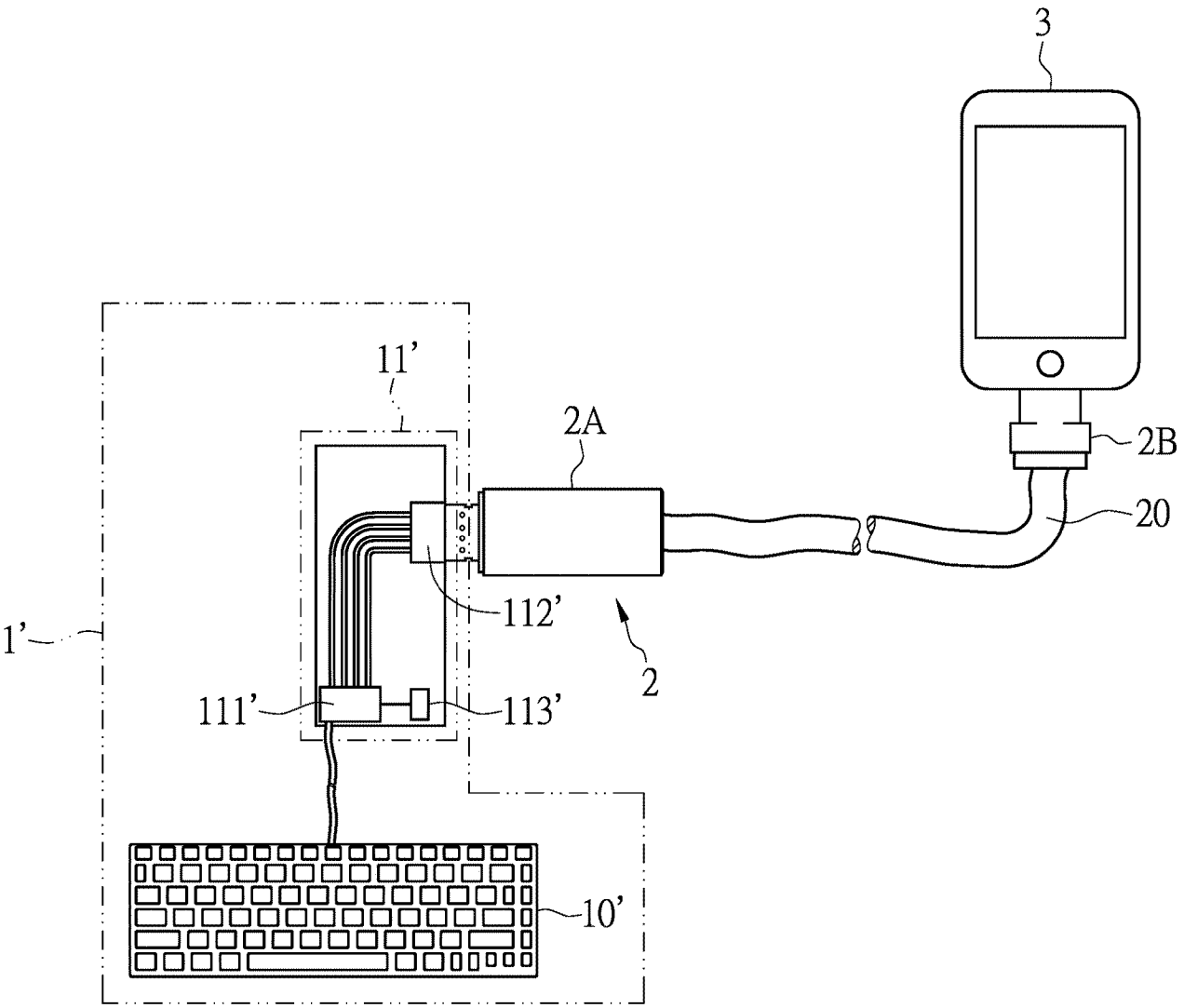
FIG. 3 is a schematic diagram of another peripheral device electrically connected to an electronic device through a transmission cable according to an embodiment of the present disclosure.

Reference is made to FIG. 3, which is a schematic diagram of another peripheral device electrically connected to an electronic device through a transmission cable according to an embodiment of the present disclosure.

In the embodiment, the peripheral device 1' of FIG. 3 is similar to the peripheral device 1 of FIG. 2, however, the difference is that the body 10' of the peripheral device 1' is a keyboard. Therefore, the peripheral device 1' can be electrically connected to the electronic device 3 through the connector module 11' and the transmission cable 2.

In other words, when the connector module 11' is connected to an electronic device 3 through the power positive terminal (not shown), the power negative terminal (not shown), the signal positive terminal (not shown), and the signal negative terminal of the connector receptacle 112' and the transmission cable 2, the processing unit 111' detects whether the electronic device 3 is in a master mode or a slave mode.

When the connector module 11' is connected to the electronic device 3 through the power positive terminal (not shown), the power negative terminal (not shown), the signal positive terminal (not shown), and the signal negative terminal of the connector receptacle 112' and the transmission cable 2, and the electronic device 3 is in the slave mode, the processing unit 111' transmits a notification signal to the electronic device through the signal positive terminal (not shown) and the signal negative terminal (not shown) such that the electronic device 3 is switched from the slave mode to the master mode. Furthermore, the electronic device 3 is notified that it is not necessary to provide power to the peripheral device 1.

In other words, when the connector module 11' is connected to the electronic device 3 through the power positive terminal (not shown), the power negative terminal (not shown), the signal positive terminal (not shown), and the signal negative terminal of the connector receptacle 112' and the transmission cable 2, the electronic device 3 is in the master mode.

In the master mode, the user can transmit a control signal to the electronic device 3 through the peripheral device 1'. In the embodiment, the peripheral device 1' can transmit a control signal to the electronic device 3 to input a message.

For example, when the peripheral device 1 is a mouse, and is connected to a mobile phone through the connector module 11 or the connector module 11' of the previous embodiment, the peripheral device 1 (i.e., the mouse) transmits a notification signal to the mobile phone through the signal positive terminal (not shown) and the signal negative terminal (not shown) to notify the mobile phone to be switched from the slave mode to the master mode. Furthermore, the mobile phone is also notified that it is not necessary to provide power to the peripheral device 1 (mouse).

In conclusion, the peripheral device of the embodiment of the present disclosure can achieve the OTG (On the Go) function by using the connector module capable of identifying a master-slave mode and the common four-core transmission cable. The purchase cost can therefore be greatly reduced for a user.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A peripheral device having a connector receptacle that is capable of identifying a master-slave mode, comprising:

a body; and a connector module disposed on the peripheral device body, wherein the connector module includes:

a processing unit;

an energy storage unit electrically connected to the processing unit to provide power to the processing unit; and a connector receptacle electrically connected to the processing unit, the connector receptacle being a Type-A universal serial bus connection receptacle, the connector receptacle including a power positive terminal, a power negative terminal, a signal positive terminal, and a signal negative terminal;

wherein when the connector module is connected to an electronic device through the power positive terminal, the power negative terminal, the signal positive terminal, the signal negative terminal, and a transmission cable, the processing unit detects whether the electronic device is in a master mode or a slave mode and whenever the electronic device is just in the slave mode, the processing unit transmits a notification signal to the electronic device through the positive terminal of the signal and the negative terminal of the signal to notify the electronic device that the electronic device does not need to provide power to the peripheral device and the electronic device is switched from the slave mode to the master mode, the power negative terminal is connected to a signal ground.

2. The peripheral device of claim 1, wherein the transmission cable is a four-core cable;

wherein the transmission cable includes a first connection module having a Type-A universal serial bus connector, a cable body and a second connection module having a Type-A universal serial bus connector.

3. The peripheral device of claim 1, wherein when the connector module is connected to the electronic device through the power positive terminal, the power negative terminal, the signal positive terminal, and the signal negative terminal of the connector receptacle and the transmission cable, the electronic device is in the master mode.

4. The peripheral device of claim 1, wherein data of the peripheral device is able to be read by a user through the electronic device.

5. The peripheral device of claim 1, wherein the energy storage unit is a battery, a super capacitor, or a DC-DC regulator.

6. The peripheral device of claim 1, wherein the peripheral device is a keyboard, a mouse, a mouse pad, and a wearable electronic device.

7. The peripheral device of claim 1, wherein the electronic device is a mobile phone, a tablet computer, a smart watch, and a wearable electronic device.

8. A peripheral device having a connector module that is capable of identifying a master-slave mode, comprising:

a body; and a connector module disposed on the peripheral device body, wherein the connector module includes:

a processing unit;

an energy storage unit electrically connected to the processing unit to provide power to the processing unit; and a connector receptacle electrically connected to the processing unit, the connector receptacle being a Type-A universal serial bus bar connection receptacle, the connector receptacle including a power positive terminal, a power negative terminal, a signal positive terminal, and a signal negative terminal;

wherein, when the connector module is connected to an electronic device through the power positive terminal, the power negative terminal, the signal positive terminal, the signal negative terminal of the connector receptacle, and a transmission cable, the processing unit detects whether the electronic device is in a master mode or a slave mode and whenever the electronic device is just in the slave mode, and the processing unit transmits a notification signal to the electronic device through the signal positive terminal and the signal negative terminal to notify the electronic device to switch from the slave mode to the master mode, the power negative terminal is connected to a signal ground.

9. The peripheral device of claim 8, wherein when the connector module is connected to the electronic device through the power positive terminal, the power negative terminal, the signal positive terminal, and the negative terminal of the connector module, and the transmission cable, the peripheral device provides the notification signal to the electronic device through the signal positive terminal.

* * * * *